US009077087B2

(12) United States Patent
Rowell

(10) Patent No.: US 9,077,087 B2
(45) Date of Patent: Jul. 7, 2015

(54) ANTENNAS USING OVER-COUPLING FOR WIDE-BAND OPERATION

(71) Applicant: Hong Kong Applied Science and Technology Research Institute Co., Ltd., Shatin, New Territories (CN)

(72) Inventor: Corbett Ray Rowell, TaiPo (CN)

(73) Assignee: Hong Kong Science and Technology Research Institute Co., Ltd., Shatin (HK)

( * ) Notice: Subject to any disclaimer, the term of this patent is extended or adjusted under 35 U.S.C. 154(b) by 282 days.

(21) Appl. No.: 13/774,621

(22) Filed: Feb. 22, 2013

(65) Prior Publication Data

US 2014/0240189 A1 Aug. 28, 2014

(51) Int. Cl.
*H01Q 1/38* (2006.01)
*H01Q 21/30* (2006.01)
*H01Q 5/40* (2015.01)

(52) U.S. Cl.
CPC . *H01Q 21/30* (2013.01); *H01Q 5/40* (2015.01)

(58) Field of Classification Search
CPC ..... H01Q 21/30; H01Q 5/0072
USPC ..... 343/700 MS, 702
See application file for complete search history.

(56) References Cited

U.S. PATENT DOCUMENTS 4,382,238 A 5/1983 Makimoto et al.
4,749,996 A 6/1988 Tresselt
4,777,490 A * 10/1988 Sharma et al. ..... 343/754
5,043,738 A * 8/1991 Shapiro et al. ..... 343/700 MS
6,043,786 A 3/2000 Vannatta et al.
6,252,552 B1 6/2001 Tarvas et al.
6,466,172 B1 10/2002 Ryken et al.
6,957,080 B2 10/2005 Guetre et al.
7,239,279 B2 7/2007 Wen et al.
7,408,512 B1 * 8/2008 Rodenbeck et al. ... 343/700 MS
7,848,771 B2 * 12/2010 Boyle ..... 455/550.1

(Continued)

FOREIGN PATENT DOCUMENTS

CN 1203464 A 12/1998
CN 101167215 A 4/2008

(Continued)

OTHER PUBLICATIONS

Office Action issued for Chinese Patent Application No. 201310169664.6 dated Jan. 6, 2015, 11 pages with English Language Translation.

*Primary Examiner* — Tho G Phan
(74) *Attorney, Agent, or Firm* — Norton Rose Fulbright US LLP

(57) ABSTRACT

Systems and methods in which antenna system configurations use over-coupling between a plurality of antenna elements for effectively providing wide-band operation are shown. Such over-coupling comprises a multiple antenna element configuration in which adaptation to one antenna element (e.g., an influencing antenna element) results in substantial operational frequency band adaptation to a second antenna element (e.g., a respondent antenna element). Over-coupling results in a frequency split at the second antenna, whereby the resonate frequency of the antenna element is split into a plurality of frequency bands. By implementing such frequency splitting with respect to otherwise narrow band antenna elements, the over-coupled antenna system may be made to effectively provide wide-band operation.

37 Claims, 4 Drawing Sheets

(56) References Cited

U.S. PATENT DOCUMENTS

| | | | | |
|---|---|---|---|---|
| 7,889,136 | B2 | 2/2011 | Mao et al. | |
| 7,990,319 | B2 | 8/2011 | Boyle | |
| 8,547,283 | B2 * | 10/2013 | Wong et al. | 343/702 |
| 8,860,623 | B2 * | 10/2014 | Lo et al. | 343/841 |
| 2005/0162334 | A1 | 7/2005 | Saunders et al. | |

FOREIGN PATENT DOCUMENTS

| | | | |
|---|---|---|---|
| CN | 101847785 | A | 9/2010 |
| WO | WO-2004010533 | A1 | 1/2004 |

* cited by examiner

ANTENNAS USING OVER-COUPLING FOR WIDE-BAND OPERATION

TECHNICAL FIELD

The present invention relates generally to wireless communications and, more particularly, to antenna configurations using over-coupling between a plurality of antenna elements to provide wide-band operation.

BACKGROUND OF THE INVENTION

The use of wireless communications has become prevalent in modern society. Wireless systems are utilized daily by business, individuals, governments, etc. to provide voice and data communication. For example, cellular phones, particular "smart phones" having advanced processing as well as communication capabilities, are in widespread use daily by persons from all walks of life.

With the proliferation of wireless communications there has been a rise in awareness of the potential for harm to human tissue from exposure to high levels of radiated energy. Accordingly, many governments have established limits on the amount of energy irradiated into a portion of the body of a user of a wireless device. The United States Federal Communications Commission (FCC) has, for example, has established a specific absorption ratio (SAR) of 1.6 milliwatts per gram (mW/g) with respect to cellular phones and other personal communications devices. Similarly, the European Union European Committee for Electrotechnical Standardization (CENELEC) has established a SAR of 2.0 mW/g in a 10 g segment for the foregoing personal communications devices. The standards imposed by such government entities not only establish the acceptable SAR value, but also proscribe the area of the human body where the SAR is to be measured. In particular, both the FCC and CENELEC require that the SAR be measured at the user's ear.

Although the currently established SAR requirements are generally easily met by communications devices implementing narrow-band antenna configurations, such narrow-band antenna configurations are often not well suited for use with respect to many modern communications devices. For example, the aforementioned smart phones generally provide for both voice and high-speed data communication, often using third-generation (3G), fourth-generation (4G), and long term evolution (LTE) communications protocols. Moreover, personal communications devices are utilized around the world, often with a particular user utilizing his/her communication device in multiple countries. Such communications are typically accommodated through the use of wide-band antenna configurations by the communications devices, such as to accommodate voice and data communications bands, communications bands of different standards and different geographic regions/countries, etc.

Unfortunately, meeting the SAR requirements imposed by one or more government entity, particularly the SAR requirements of the FCC, is problematic when wide-band antenna configurations are utilized. In particular, the wide-band antennas implemented by such communications devices in order to facilitate operations such as accommodating both voice and high-speed data, operating with protocols such as 3G, 4G, LTE, etc., and/or provide a device which is operable globally, generally provide higher SAR levels than a more narrow-band antenna. For example, transmission of a signal, using a planar monopole antenna commonly implemented in smart phones today, at 1800 MHz as measured in a 1 g soft tissue analog sample at a depth of 10 mm, in accordance with the FCC SAR standards, results in a SAR measurement of 3.4, which is well over the FCC limit of 1.6. Similarly, transmission of a signal, using a planar monopole antenna, at 1800 MHz as measured in a 10 g soft tissue analog sample at a depth of 10 mm, in accordance with the CENELEC standards, results in a SAR measurement of 1.9, which is narrowly within the CENELEC limit of 2.0.

Accordingly, manufacturers of personal communications devices, such as smart phones, have adopted designs which physically place the wide-band antennas used thereby to be located as far away from the area in which SAR measurements are made in order to assure compliance. Specifically, because the SAR is typically specified as being measured at the user's ear, manufacturers have adopted configurations in which the antennas of personal communications devices are disposed at the end of the device away from the earpiece (i.e., near the mouthpiece or microphone end of the device).

Although the foregoing technique has generally been acceptable for implementing wide-band antenna configurations in personal communications systems which meet the various SAR requirements, the solution is not without disadvantage. For example, should a need arise to implement more than one transmit antenna, such as for multiple-input multiple-output (MIMO) protocols, the additional antenna elements would be located more near to the area in which SAR measurements are made, thus likely resulting in an inability to comply with SAR requirements.

Other techniques may be considered for providing communications device configurations which provide wide-band communication support while meeting SAR requirements. However, each such alternative is likewise associated with disadvantages.

For example, the use of meta-materials has been discussed with respect to antenna configurations adapted to provide suitable SAR performance. However, meta-materials are inherently narrow-band as a result of their effectively forming a LC trap resonator. In order to provide a wide-band antenna configuration using such meta-materials, the antenna element must generally be relatively large, thereby presenting a solution which is problematic with respect to the relatively small size of personal communication devices.

As another example, the use of active circuits may be considered, whereby the operational frequency of the antenna system may be tuned as needed for transmission/reception of signals. However, many modern personal communication systems, such as smart phones, must monitor a number of different frequencies (e.g., for handoff, carrier aggregation, etc.). Accordingly, the adaptive circuits would need to switch extremely fast in order to provide the requisite operation. However, such fast switching adaptive circuits are neither inexpensive nor small, thereby providing a solution which is not well suited for personal communications devices.

Another alternative for meeting the SAR requirements may be to implement a baseband solution. For example, certain operations, such as data transmission, may be discontinued during activity in which the communication device is placed near the user's head (e.g., during a voice call) to thereby provide reduced SAR. However, such solutions are generally objectionable to the users of the communications devices as the performance of the device is lessened.

BRIEF SUMMARY OF THE INVENTION

The present invention is directed to systems and methods in which antenna system configurations use over-coupling between a plurality of antenna elements for effectively providing wide-band operation. Over-coupling as used herein comprises a multiple antenna element configuration in which the antenna elements are configured so that adaptation to one antenna element (e.g., an influencing antenna element) results in substantial operational frequency band adaptation to a second antenna element (e.g., a respondent antenna element) of the over-coupled antenna system. In operation according to embodiments of the invention, over-coupling results in a frequency split at the second antenna, whereby the resonate frequency of the antenna element is split into a plurality of frequency bands. By implementing such frequency splitting with respect to otherwise narrow band antenna elements, the over-coupled antenna system may be made to effectively provide wide-band operation. For example, antenna element configurations (e.g., planar antenna elements such as planar inverted F antennas (PIFA)) which typically provide relatively narrow-band operation (e.g., approximately 12% bandwidth) may be adapted to provide an over-coupled antenna system providing relatively wide-band operation (e.g., approximately 38% bandwidth).

In providing an antenna system configuration implementing over-coupling according to embodiments herein, a plurality of antenna elements, such as may comprise PIFA antenna elements, are disposed within a coupling distance from one another (e.g., a separation distance selected to result in coupling between an influencing and respondent antenna element pair). According to embodiments, an influencing antenna element of the antenna system is adapted to provide a frequency split in a respondent antenna element of the antenna system by embedding a multi-pole bandstop filter, which is adapted for over-coupling operation, into the influencing antenna element. In particular, the embedded bandstop filter of embodiments is adapted for over-coupling operation through selection of the attributes of the bandstop filter to induce coupling between the influencing and respondent antenna elements.

The frequency split realized at a respondent antenna element of an over-coupled antenna system is preferably selected by adaptation of the bandstop filter embedded at a corresponding influencing antenna element to provide antenna frequency response which, when aggregated with the frequency response of the influencing antenna element, effectively provides wide-band operation by the over-coupled antenna system. It should be appreciated that the aggregated frequency response implemented by an over-coupled antenna system of embodiments herein is not limited to a resonate frequency band of a first antenna element and a plurality of split resonate frequency bands of a second antenna element. For example, an over-coupled antenna system may comprise more than two antenna elements, wherein a plurality of influencing antenna elements are adapted to induce frequency splits at corresponding respondent antenna elements, whereby the aggregated frequency response of all of these antenna elements are used to provide desired wide-band operation. Moreover, in addition to the use of over-coupling techniques herein to provide wide-band operation, antenna elements may be directly adapted to provide wide-band operation. For example, a planar antenna element of an over-coupled antenna system may include slots or other adaptations to itself be adapted for operation in one or more resonate frequency bands.

The over-coupled antenna systems of embodiments of the invention provide a relatively small antenna configuration which may be utilized in meeting SAR requirements. For example, a configuration implementing PIFA antenna elements may be configured to provide wide-band operation in a range of frequencies with an antenna system footprint which is compatible with personal communication devices, such as smart phones. Such an over-coupled antenna system may be disposed in a personal communication device, even at a position that will be placed near the ear of a user, and still provide acceptable SAR. Accordingly, over-coupled antenna systems herein may, for example, be disposed in a personal communication device (e.g., at a position near the earpiece) and used in combination with a more traditional antenna system (e.g., a planar monopole antenna disposed at the end of the device away from the earpiece) to facilitate multiple transmit MIMO operation or other communications protocols (e.g., LTE rel. 10).

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWING

For a more complete understanding of the present invention, reference is now made to the following descriptions taken in conjunction with the accompanying drawing, in which.

DETAILED DESCRIPTION OF THE INVENTION

Figure 1A:
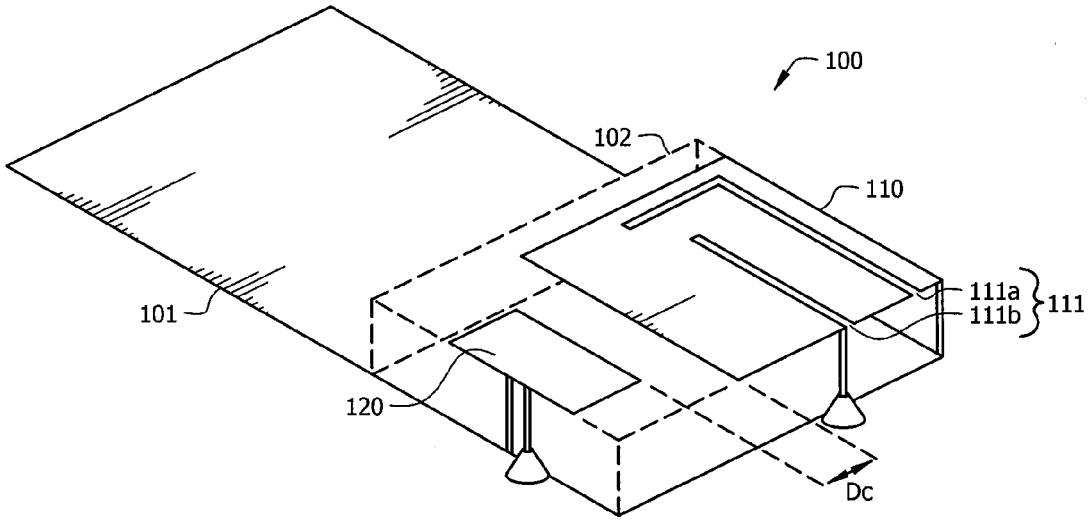
FIG. 1A shows a configuration of an over-coupled antenna system according to embodiments of the invention.

FIG. 1A shows over-coupled antenna system 100 according to embodiments of the invention. Over-coupled antenna system 100 of the illustrated embodiment implements over-coupling between antenna elements 110 and 120 thereof for effectively providing wide-band operation. In particular, in the over-coupling configuration shown in FIG. 1A, adaptation to antenna element 110, here an "influencing antenna element", results in substantial operational frequency band adaptation to antenna element 120, here a "respondent antenna element" of over-coupled antenna system 100.

Although various antenna element configurations may be utilized according to embodiments of the invention, to aid in understanding the concepts herein the illustrated embodiment shows a configuration in which antenna elements 110 and 120 are planar antenna elements. Accordingly, antenna elements 110 and 120 are each illustrated as planar conductors disposed in correspondence with a ground plane, shown here as ground plane 101, and separated therefrom by a dielectric material, shown as dielectric 102. The illustrated embodiment of antenna elements 110 and 120, therefore, provides a microstrip or patch antenna configuration of antenna elements, as are well known in the art. Antenna element 110 and/or antenna element 120 may, for example, comprise a planar inverted F antenna (PIFA). In any case, antenna elements 110 and 120 are each active antenna elements, having signal feed networks associated therewith, and thus are not to be confused with a configuration wherein an active antenna element employs one or more corresponding passive element (e.g., reflectors and/or directors employed for providing directionality or beam shaping).

Although not shown in FIG. 1A, it should be appreciated that antenna system 100 may be coupled to various communication circuitry. For example, signal feed lines of antenna elements 110 and 120 may be coupled to one or more radio receiver and/or radio transmitter (including radio transceivers). Additionally or alternatively, circuitry such as combiners/splitters, matching circuits, amplifiers, filters, etc., may be coupled to the antenna elements to provide desired operation.

The antenna elements of over-coupled antenna system 100 are configured for providing an antenna system configuration implementing over-coupling according to embodiments herein. For example, as described in detail below, the antenna elements are disposed in proximity to provide coupling and the influencing antenna element is specifically adapted to cause operational frequency band adaptation at the respondent antenna element.

As illustrated in FIG. 1A, antenna elements 110 and 120 are disposed within a coupling distance, $D_c$, from one another. In accordance with embodiments of the invention, the coupling distance is a separation of less than $\lambda/4$ (i.e., $D_c<\lambda/4$), wherein $\lambda$ is the resonant wavelength corresponding to the resonant frequency of the respondent antenna element. Accordingly, the edge to edge separation of antenna elements 110 and 120 of the illustrated embodiment is the coupling distance $D_c$, which is less than $\lambda/4$. For example, the coupling distance utilized according to embodiments herein may be $\lambda/8$.

It should be appreciated that, in addition to disposing the influencing and respondent antenna elements a distance apart which is selected to result in coupling therebetween (a practice that is conventionally avoided in antenna system design), the illustrated embodiment of over-coupled antenna system 100 includes features further promoting coupling between the antenna elements. For example, ground plane 101 provides a common ground plane with respect to influencing antenna element 110 and respondent antenna element 120, despite it being common practice in conventional antenna system design to separate ground planes of the antenna elements for providing isolation.

Influencing antenna element 110 is adapted to cause operational frequency band adapted at respondent antenna element 120 of over-coupled antenna system 100. In the illustrated embodiment, influencing antenna element 110 is adapted to provide a frequency split in respondent antenna element 120 through operation of one or more feature of influencing antenna element 110 adapted for over-coupling operation. In particular, influencing antenna element 110 of the illustrated embodiment includes bandstop filter 111 embedded therein which is adapted to cause the aforementioned frequency split in respondent antenna element 120.

Bandstop filter 111 of the illustrated embodiment comprises a multi-pole bandstop filter, comprising slot 111*a* providing a first pole and slot 111*b* providing a second pole of the multi-pole bandstop filter. Bandstop filter 111 of embodiments is adapted for over-coupling operation through selection of the anti-resonance frequency for each pole of the bandstop filter to be within 40% of the anti-resonance frequency for another pole of the bandstop filter (e.g., a length of slot 111*a* and a length of slot 111*b* may be within 40% of each other) and selection of these anti-resonance frequencies to be in the resonate frequency region of the respondent antenna element or near the resonate frequency region of the respondent antenna element (e.g., the bandstop filter cutoff frequency is outside of the resonate frequency region of the respondent antenna element, but the bandstop filter cutoff frequency is within ±20% the nearest cutoff of the resonate frequency region of the respondent antenna element). For example, where the configuration of respondent antenna element 120 without over-coupling operation herein would provide a resonant center frequency of 1.95 GHz, and an operational frequency band of 1.80-2.05 GHz, bandstop filter 111 may be adapted so that the anti-resonance frequencies of the poles associated with slots 111*a* and 111*b* are approximately at 1.8 GHz and 2.0 GHz, respectively to thereby provide anti-resonance frequencies within 40% of each other (in this example falling within 25% of each other) and falling within the resonant band of the respondent antenna element.

Figure 1B:
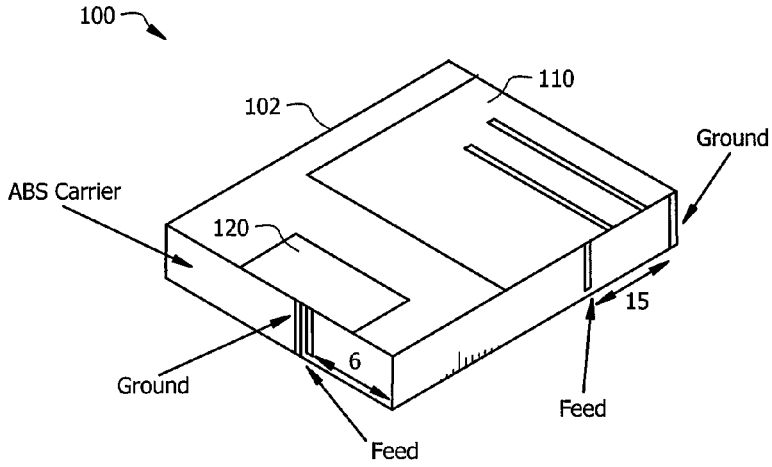
FIGS. 1B and 1C show a specific embodiment of an over-coupled antenna system.
Figure 1C:
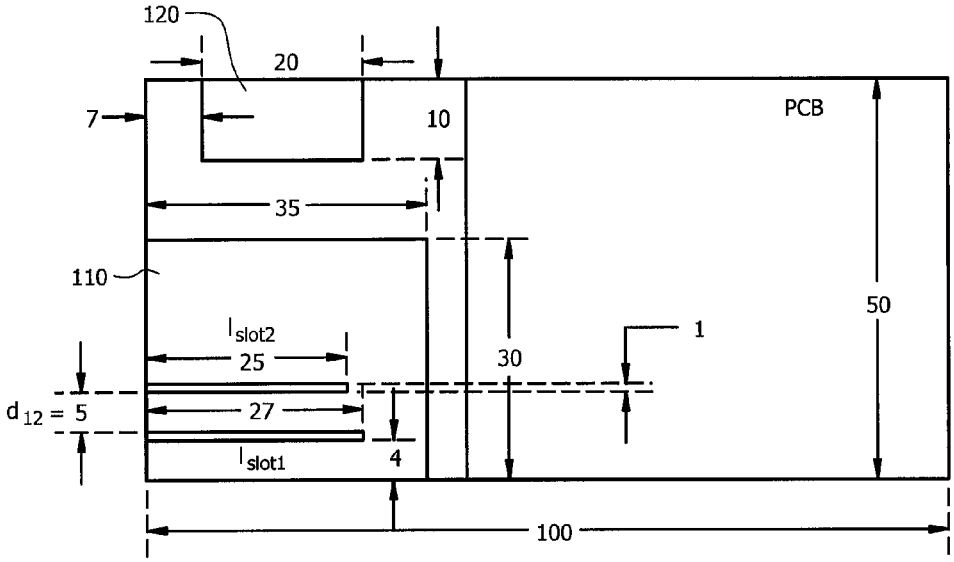

By way of specific, non-limiting, example of an embodiment of an over-coupled antenna system according to the concepts herein, a two antenna element antenna system may be designed as described below and as shown in FIGS. 1B and 1C, wherein all dimensions shown are in millimeters: The influencing antenna (Antenna 1) dimensions in the illustrated embodiment are designed for an impedance resonance of 1040 MHz (such that the 50Ω matched resonance is 900 MHz) with dimensions of $\{L_1, W_1, H_1\}=\{30\text{ mm}, 35\text{ mm}, 8\text{ mm}\}$ where $L_1+W_1=\lambda/4\sqrt{\epsilon_r}$. Similarly, the respondent antenna (Antenna 2) dimensions are designed for impedance resonance $f_1^{ant2}=2.1$ GHz with dimensions of $\{L_2, W_2, H_2\}=\{20\text{ mm}, 7\text{ mm}, 8\text{ mm}\}$ where $L_2+W_2+H_2=\lambda/4\sqrt{\epsilon_r}$. Since the antenna height is comparable to the antenna width, it forms part of the resonating length of the antenna. Two slots are placed between the feed and the ground connections in the influencing antenna such that $f_1^{ant2}$ is split into two resonances by the notch antiresonance $f^{ant2}_{notch}$. The optimal notch resonance in this design is slightly offset from the original impedance resonance: $f^{ant2}_{notch}=f_1^{ant2}+\Delta f$, where $\Delta f=20$ MHz Or $((l_{slot1}, l_{slot2})+d_{12})\cong(L_2+W_2+H_2)-4$ mm. The resulting dimensions are $l_{slot1}=27$ mm, $l_{slot2}=25$ mm, and $d_{12}=5$ mm. The foregoing embodiment of an over-coupled two antenna system has one resonant frequency in the 1 GHz band, one resonant frequency in the 3 GHz band, and four resonant frequencies in the 2 GHz band.

Figure 2:
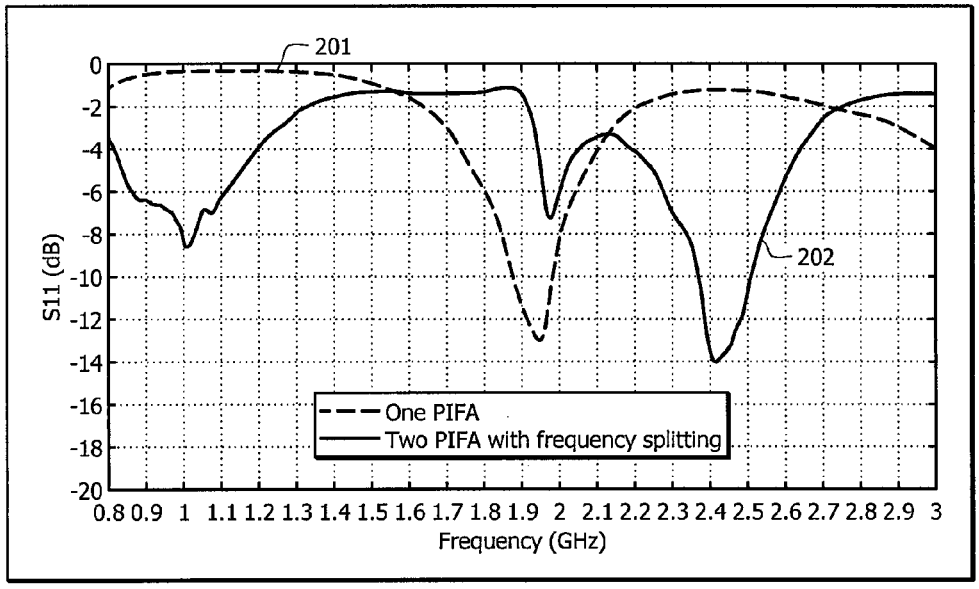
FIG. 2 illustrates frequency splitting provided by over-coupled antenna elements according to embodiments of the invention.

In operation according to embodiments of the invention, the foregoing over-coupling results in a frequency split at the second antenna, whereby the resonate frequency of the antenna element is split into a plurality of frequency bands. This frequency splitting is illustrated in the graph of FIG. 2, wherein line 201 illustrates the S11 (i.e., a parameter measuring how much power is reflected back into the circuit from the antenna element) response of an antenna element configured the same as that of respondent antenna element 120 without the aforementioned over-coupling, and line 202 illustrates the S11 response of respondent antenna element 120 with over-coupling operation associated with influencing antenna element 110. As can be seen from the graph of FIG. 2, the frequency response of respondent antenna element 120 has been split from a single resonant frequency band having a center frequency of approximately 1.95 GHz to two resonant frequency bands; one having a center frequency of approximately 1.10 GHz and one having a center frequency of approximately 2.41 GHz. ZBandstop filter 111 utilized in producing the results shown in FIG. 2 included a multi-pole configuration in which the anti-resonance frequency of one pole is 1.9 GHz and the anti-resonance frequency of another pole is 2.3 GHz.

By implementing frequency splitting according to embodiments herein, the over-coupled antenna system comprising otherwise narrow band antenna elements (e.g., which provide relatively good SAR characteristics) may be made to effectively provide wide-band operation. For example, the frequency split realized at a respondent antenna element of an over-coupled antenna system is preferably selected by adaptation of the bandstop filter embedded at a corresponding influencing antenna element to provide antenna frequency response which, when aggregated with the frequency response of the influencing antenna element, effectively provides wide-band operation by the over-coupled antenna system.

Figure 3:
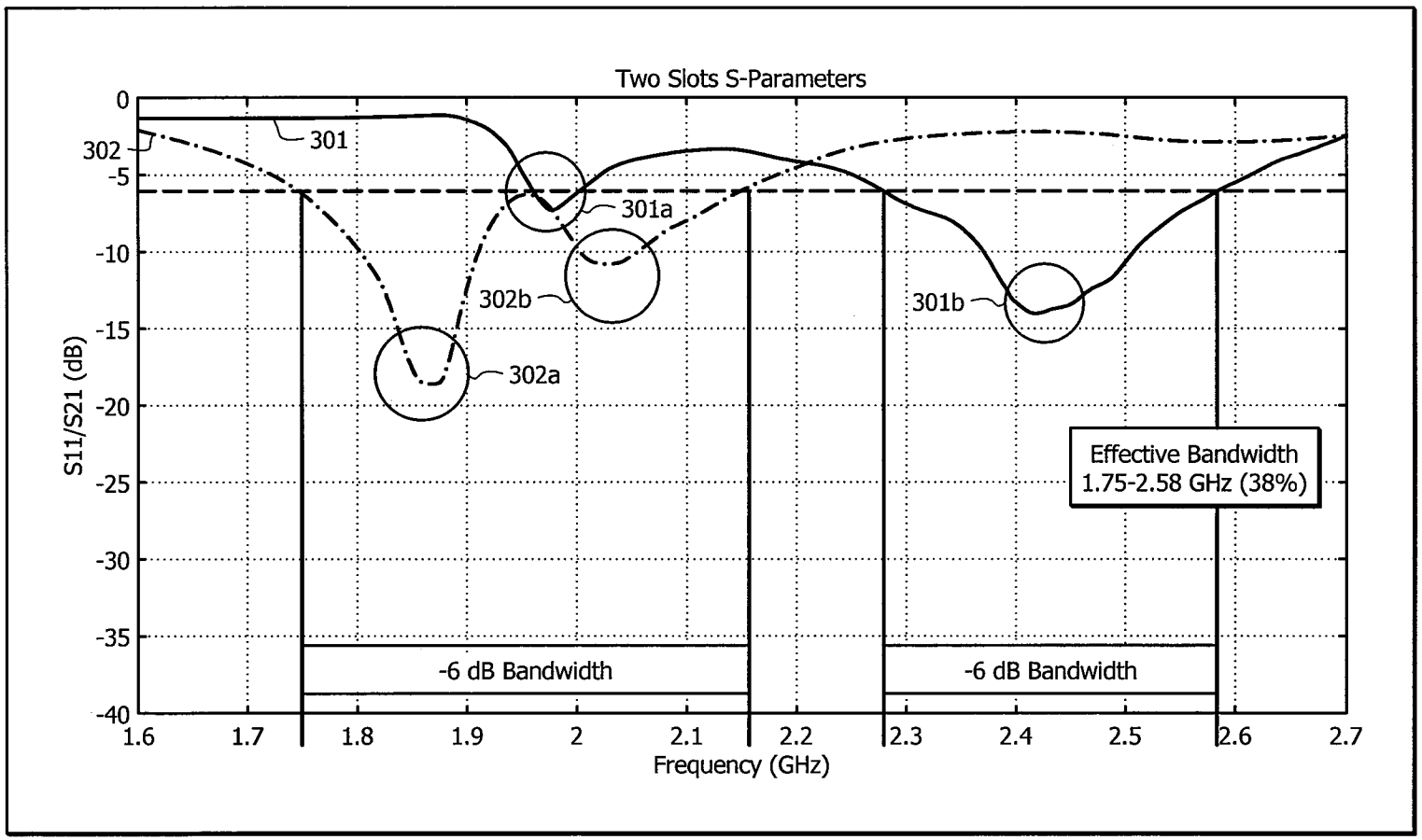
FIG. 3 illustrates wide-band aggregated frequency response of an over-coupled antenna system according to embodiments of the invention.

The aggregated frequency response provided by an over-coupled antenna system according to embodiments of the invention is shown in the graph of FIG. 3. Specifically, line 301 shows the S11 response of influencing antenna element 110 and line 302 shows the S21 response of respondent antenna element 120. As can be seen in the graph of FIG. 3, resonate frequency peak 301*a* (having a peak at approximately 1.97 GHz and an associated resonant frequency band of approximately 1.95-2.10 GHz) associated with influencing antenna element 110 and resonate frequency peaks 302*a* (having a peak at approximately 1.87 GHz and an associated resonant frequency band of approximately 1.75 GHz-1.95 GHz) and 302*b* (having a peak at approximately 2.25 GHz and an associated resonant frequency band of approximately 1.95-2.17 GHz) provide an aggregated frequency response of approximately 1.75-2.17 GHz.

It should be appreciated that the aggregated frequency response implemented by an over-coupled antenna system of embodiments herein is not limited to a resonate frequency band of a first antenna element and a plurality of split resonate frequency bands of a second antenna element. For example, in addition to the use of over-coupling techniques herein to provide wide-band operation, antenna elements may be directly adapted to provide wide-band operation. For example, influencing antenna element 110 may include slots or other adaptations to itself be adapted for operation in one or more resonate frequency bands. Such multiple self-resonances are illustrated in the graph of FIG. 3. In particular, line 301 showing the S11 response of influencing antenna element 110 includes resonant frequency peak 301*b* in addition to aforementioned resonant frequency peak 301*a*. Such multiple resonant frequency bands may be used in the aforementioned aggregated frequency response to provide a desired frequency response band with respect to over-coupled antenna system 100 of embodiments herein.

Additionally or alternatively, an over-coupled antenna system may comprise more than the two antenna elements of the embodiment illustrated herein. Accordingly, a plurality of influencing antenna elements may be provided where each is adapted to induce a frequency split at corresponding respondent antenna element (which itself may be an influencing antenna element with respect to another respondent antenna element), whereby the aggregated frequency response of all of these antenna elements may be used to provide desired wide-band operation.

As can be appreciated from the foregoing, antenna element configurations which typically provide relatively narrow-band operation (e.g., PIFA configurations) may be adapted to provide an over-coupled antenna system providing relatively wide-band operation. This is illustrated in the graph of FIG. 3, wherein the aggregated frequency response bandwidth for the over-coupled antenna system represented therein is approximately 38% bandwidth, wherein bandwidth is determined by the difference between the operational frequency range high frequency cutoff and low frequency cutoff divided by the center frequency (bandwidth=$(f_{high}-f_{Low})/f_{center}$)). This aggregated frequency response may be compared to a planar antenna element configuration which may provide approximately 12% bandwidth without over-coupled operation. It should be appreciated that, in cellular telephony, antennas having bandwidths less than or equal to approximately 15% are considered narrow band antennas, while antennas having bandwidths above approximately 25% are considered wide band antennas. Accordingly, over-coupled antenna system 100 of embodiments herein provides an aggregated frequency response which is wide-band at least with respect to cellular telephony implementations.

It should be appreciated that the aggregated frequency response provided through over-coupling herein need not be contiguous according to embodiments of the invention. For example, a frequency split realized at a respondent antenna element of an over-coupled antenna system may be selected to provide an intermediate frequency band at which the antenna system is not resonate, such as to avoid interfering signals etc. This is illustrated in the graph of FIG. 3, wherein the high cutoff frequency of the resonant frequency band associated with split frequency resonate frequency peak 302*b* of respondent antenna element 120 and the low cutoff frequency of the resonant frequency band associated with self-resonance frequency peak 301*b* of influencing antenna element 110 define a non-resonate intermediate frequency band at approximately 2.17-2.30 GHz. Such a non-resonate intermediate frequency band may be useful, for example, in a cellular telephony system to avoid potentially interfering signals while providing wide-band cellular operation (e.g., LTE currently does not provide for communications in this intermediate frequency band). Such intermediate frequency bands, whether between the resonant frequency bands of two antenna elements or between the split frequencies of a single antenna element, may be selected to avoid various interfering signals, such as GPS signals, the signals of a competing carrier, radar installations, etc.

Embodiments of over-coupled antenna system 100 herein provide a relatively small antenna configuration which may be utilized in meeting relatively high SAR requirements. In particular, embodiments implementing a PIFA configuration with respect to the antenna elements thereof implement an architecture in which the ground plane thereof provide current distribution in such a way as to result in relatively low SAR as measured in the soft tissue of a user. Although PIFA antenna elements are typically very narrow-band, and thus despite their relatively good SAR performance are not typically candidates for wide-band communications in personal communications systems, over-coupling techniques herein overcome this aspect of the PIFA antenna elements. Accordingly, a configuration implementing PIFA antenna elements may be configured to provide wide-band operation in a range of frequencies (e.g., 1.8-2.8 GHz for accommodating worldwide smart phone operation) with an antenna system footprint which is compatible with personal communication devices, such as smart phones.

The table below shows exemplary SAR measurements for the over-coupled antenna system represented in the graph of FIG. 3. As can be seen from the SAR measurements below, such an over-coupled antenna system may be disposed in a personal communication device, even at a position that will be placed near the ear of a user, and still provide acceptable SAR (e.g., a SAR of 1.3 at 1900 MHz measured in a 1 g soft tissue analog sample at a depth of 10 mm in accordance with the FCC SAR standards and a SAR of 0.8 at 1900 MHz as measured in a 10 g soft tissue analog sample at a depth of 10 mm in accordance with the CENELEC standards). Accordingly, over-coupled antenna systems herein may, for example, be disposed in a personal communication device (e.g., at a position near the earpiece) and used in combination with a more traditional antenna system (e.g., a planar monopole antenna disposed at the end of the device away from the earpiece) to facilitate multiple transmit MIMO operation or other communications protocols (e.g., LTE rel. 10).

SAR Measurement Results

| | Frequency (MHz) | | |
|---|---|---|---|
| | Over-Coupled Antenna System 1900 MHz | Ungrounded Monopole Antenna System 1800 MHz | SAR Requirements |
| (ANSI/IEEE) Max 1 g SAR (W/kg) d = 0 mm | 4.6 | 11.3 | 1.6 (FCC) |
| (ANSI/IEEE) Max 1 g SAR (W/kg) d-10 mm | 1.3 | 3.4 | 1.6 (FCC) |
| (ICNIRP) Max 10 g SAR (W/kg) d-0 mm | 2.6 | 6.1 | 2 (CENELEC) |
| (ICNIRP) Max 10 G SAR (W/kg) d = 10 mm | 0.8 | 1.9 | 2 (CENELEC) |

Of course, over-coupled antenna systems in accordance with embodiments of the invention may be utilized in communication devices other than the personal communication devices mentioned above. For example, wide-band operation provided by over-coupled antenna systems according to embodiments of the invention may be utilized for providing wide-band communication associated with orthogonal frequency division multiplex (OFDM) communications, such as may be utilized by broadband data communications (e.g., WiMAX).

Although embodiments herein have been described with reference to the use of planar antenna element configurations, embodiments herein may utilize other configurations of antenna elements. For example, an embodiment of an over-coupled antenna system may utilize a planar antenna element as one antenna element (e.g., an influencing antenna element) and a dipole antenna as another antenna element (e.g., a respondent antenna element).

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A system comprising:

a first antenna element; and a second antenna element, wherein the first antenna element and the second antenna element are provided in an over-coupled configuration, the over-coupled configuration comprising at least one feature of the first antenna element adapted to provide operational frequency band adaptation of the second antenna element for wide-band aggregated frequency response, wherein the operational frequency band adaptation comprises a frequency split with respect to the second antenna element to thereby provide a plurality of resonant frequency bands in operation of the second antenna element.

2. The system of claim 1, wherein at least one of the first antenna element and the second antenna element comprises a planar antenna element.

3. The system of claim 2, wherein the at least one of the first antenna element and the second antenna element comprises a planar inverted F antenna (PIFA) element.

4. The system of claim 2, wherein the at least one of the first antenna element and the second antenna element comprises a microstrip antenna element.

5. The system of claim 2, wherein at least one of the first antenna element and the second antenna element comprises a dipole antenna element.

6. The system of claim 2, wherein the first antenna element and the second antenna element share a same ground plane.

7. The system of claim 1, wherein one or more attribute of the at least one feature of the first antenna element is selected to result in the plurality of resonant frequency bands having desired frequency ranges.

8. The system of claim 1, wherein the at least one feature of the first antenna element comprises disposing the first antenna element within a coupling distance ($D_c$) from the second antenna element.

9. The system of claim 8, wherein $D_c$ comprises an edge to edge distance between the first antenna element and the second antenna element of less than $\lambda/4$, wherein $\lambda$ is a resonant wavelength corresponding to a resonant frequency of the second antenna element.

10. The system of claim 8, wherein $D_c$ comprises an edge to edge distance between the first antenna element and the second antenna element of less than or equal to $\lambda/8$, wherein $\lambda$ is a resonant wavelength corresponding to a resonant frequency of the second antenna element.

11. The system of claim 8, wherein the at least one feature of the first antenna element comprises embedding a multi-pole bandstop filter in the first antenna element.

12. The system of claim 11, wherein the multi-pole bandstop filter is adapted for over-coupling operation through selection of an anti-resonance frequency for each pole of the bandstop filter to be within 40% of the anti-resonance frequency for another pole of the bandstop filter and selection of these anti-resonance frequencies to be near the resonate frequency region of the second antenna element.

13. The system of claim 11, wherein the multi-pole bandstop filter is formed by two or more slots disposed within a surface of the first antenna element.

14. The system of claim 13, wherein the two or more slots each have a length which is within 40% of a length of another of the two or more slots.

15. The system of claim 1, further comprising:

a third antenna element, wherein the third antenna element is provided in an over-coupled configuration with another antenna element of an antenna system including the first, second, and third antenna elements.

16. The system of claim 15, wherein the another antenna element is the first antenna element.

17. The system of claim 15, further comprising:

a fourth antenna element, wherein the another antenna element is the fourth antenna element.

18. A method comprising:

providing an antenna system including a first antenna element and a second antenna element in an over-coupled configuration, wherein the over-coupled configuration comprises a multi-pole bandstop filter embedded in the first antenna element, wherein the multi-pole bandstop filter is adapted for over-coupling operation through selection of an anti-resonance frequency for each pole of the bandstop filter to be within 40% of the anti-resonance frequency for another pole of the bandstop filter and selection of these anti-resonance frequencies to be near the resonate frequency region of the second antenna element; and using the over-coupled antenna system to provide wide-band operation by a communication device, wherein the wide-band operation comprises at least one feature of the first antenna element causing operational frequency band adaptation of the second antenna element for wide-band aggregated frequency response from the over-coupled antenna system.

19. The method of claim 18, wherein the communication device comprises a personal communication device.

20. The method of claim 19, wherein the over-coupled antenna system is disposed in the communication device near an earpiece, and wherein the wide-band operation results in a specific absorption ratio (SAR) of less than or equal to 1.6 milliwatts per gram (mW/g) as measured in a soft tissue analog sample at a depth of 10 mm.

21. The method of claim 19, further comprising:

providing a wide-band antenna in the personal communication device in addition to the over-coupled antenna system, wherein the wide-band antenna and the over-coupled antenna system are used to provide dual transmit communication capabilities with respect to the communication device.

22. The method of claim 18, wherein at least one of the first antenna element and the second antenna element comprises a planar antenna element.

23. The method of claim 22, wherein the at least one of the first antenna element and the second antenna element is selected from the group consisting of a planar inverted F antenna (PIFA) element, and a microstrip antenna element.

24. The method of claim 18, wherein the operational frequency band adaptation comprises a frequency split with respect to the second antenna element to thereby provide a plurality of resonant frequency bands in operation of the second antenna element.

25. The method of claim 24, wherein one or more attribute of the at least one feature of the first antenna element is selected to result in the plurality of resonant frequency bands having desired frequency ranges.

26. The method of claim 18, wherein the over-coupled configuration comprises the first antenna element disposed within a coupling distance ($D_c$) from the second antenna element, wherein $D_c$ comprises an edge to edge distance between the first antenna element and the second antenna element of less than $\lambda/4$, wherein $\lambda$ is a resonant wavelength corresponding to a resonant frequency of the second antenna element.

27. The method of claim 26, wherein $D_c$ comprises an edge to edge distance between the first antenna element and the second antenna element of less than or equal to $\lambda/8$.

28. The method of claim 18, wherein the multi-pole bandstop filter is formed by two or more slots disposed within a surface of the first antenna element.

29. The method of claim 28, wherein the two or more slots each have a length which is within 40% of a length of another of the two or more slots.

30. An over-coupled antenna system providing wide-band operation for a communication device, the over-coupled antenna system comprising:

a first antenna element having a multi-pole bandstop filter embedded therein; and a second antenna element, wherein the first antenna element and the second antenna element are disposed within a coupling distance ($D_c$) from each other, wherein $D_c$ comprises an edge to edge distance between the first antenna element and the second antenna element of less than $\lambda/4$, wherein $\lambda$, is a resonant wavelength corresponding to a resonant frequency of the second antenna element, and wherein at least one attribute of the multi-pole bandstop filter embedded in the first antenna element is selected to provide operational frequency band adaptation of the second antenna element for an aggregated frequency response providing the wide-band operation.

31. The system of claim 30, wherein at least one of the first antenna element and the second antenna element comprises a planar antenna element.

32. The system of claim 30, wherein the operational frequency band adaptation comprises a frequency split with respect to the second antenna element to thereby provide a plurality of resonant frequency bands in operation of the second antenna element.

33. The system of claim 30, wherein $D_c$ comprises an edge to edge distance between the first antenna element and the second antenna element of less than or equal to $\lambda/8$.

34. The system of claim 30, wherein the a lease one attribute of the multi-pole bandstop filter selected to provide operational frequency band adaptation of the second antenna element comprises an anti-resonance frequency for each pole of the bandstop filter selected to be within 40% of the anti-resonance frequency for another pole of the bandstop filter.

35. The system of claim 34, wherein the a lease one attribute of the multi-pole bandstop filter selected to provide operational frequency band adaptation of the second antenna element further comprises the anti-resonance frequencies selected to be near the resonate frequency region of the second antenna element.

36. The system of claim 34, wherein the multi-pole bandstop filter is formed by two or more slots disposed within a surface of the first antenna element.

37. The system of claim 36, wherein the two or more slots each have a length which is within 40% of a length of another of the two or more slots.

* * * * *